US007749556B2

(12) United States Patent
Li et al.

(10) Patent No.: US 7,749,556 B2
(45) Date of Patent: Jul. 6, 2010

(54) METHOD FOR MANUFACTURING FIELD EMISSION SUBSTRATE

(75) Inventors: Hung-Yung Li, Jhudong Township, Hsinchu County (TW); Tsuey-May Yin, Taipei (TW); Tsai-Ling Ho, Taipei (TW)

(73) Assignees: Tatung Company, Taipei (TW); Industrial Technology Research Institute, Hsinchu (TW)

( * ) Notice: Subject to any disclaimer, the term of this patent is extended or adjusted under 35 U.S.C. 154(b) by 1016 days.

(21) Appl. No.: 11/477,548

(22) Filed: Jun. 30, 2006

(65) Prior Publication Data

US 2007/0243493 A1 Oct. 18, 2007

(30) Foreign Application Priority Data

Apr. 13, 2006 (TW) ..... 95113121 A

(51) Int. Cl.
*B05D 5/12* (2006.01)

(52) U.S. Cl. ..... 427/58; 427/63; 427/78; 427/97.8; 427/98.3; 445/24; 313/292; 313/466; 313/495

(58) Field of Classification Search ..... 427/58, 427/63, 78, 97.8, 98.3; 445/24; 313/292, 313/466, 495

See application file for complete search history.

(56) References Cited

U.S. PATENT DOCUMENTS

| | | | | |
|---|---|---|---|---|
| 5,717,286 | A * | 2/1998 | Itoh et al. | 313/495 |
| 5,872,420 | A * | 2/1999 | Itoh et al. | 313/292 |
| 6,116,975 | A * | 9/2000 | Saito et al. | 445/24 |
| 7,070,472 | B2 * | 7/2006 | Dean et al. | 445/24 |
| 2008/0199626 | A1 * | 8/2008 | Zhou et al. | 427/430.1 |

* cited by examiner

*Primary Examiner*—Shamim Ahmed
*Assistant Examiner*—Maki A Angadi
(74) *Attorney, Agent, or Firm*—Bacon & Thomas, PLLC

(57) ABSTRACT

A method for manufacturing a field emission substrate is disclosed. The method includes the following steps: providing a substrate having a conductive layer; forming a hydrophobic layer on the conduction layer; patterning the hydrophobic layer; and removing the hydrophobic layer from the surface of the conductive layer so that the formed layer of electron-emitting materials can contact the surface of the conductive layer. The patterned hydrophobic layer can include plural bumps, and the pitches between the neighboring bumps are in a range of 1 μm to 500 μm. By way of the steps illustrated above, the emitting layer on the substrate can be made easily and arranged accurately. Hence, the electrons can be emitted homogeneously.

21 Claims, 6 Drawing Sheets

METHOD FOR MANUFACTURING FIELD EMISSION SUBSTRATE

BACKGROUND OF THE INVENTION

1. Field of the Invention

The present invention relates to a method for manufacturing a field emission substrate and, more particularly, to a method for manufacturing a field emission substrate that is able to reduce damage to electron emitters and easily control arrangement of the electron emitters.

2. Description of Related Art

Display devices are playing an increasingly important role in people's daily life. Computers, TVs, mobile phones, PDAs, digital cameras etc., all transmit information by controlling display devices. Contrary to the conventional Cathode Ray Tube displays, the latest-generation panel displays are advantageous in that they are light, compact, and health-friendly.

Among various technologies for panel display devices, field emission displays (FED) boast not only great graphic qualities as found in conventional Cathode Ray Tube displays, but also high luminescent efficiency, short response time, good display coordination performance, high brightness of over 1000 nits, slim and light structure, wide viewing angle, broad range of working temperature, and high acting efficiency, contrary to Liquid Crystal Displays (LCD) which are problematic in narrow viewing angle, narrow working temperature range, and short response time.

Besides, FEDs do not require backlight modules, so they can provide superior brightness even when used in sunlight. With the development of nanotechnology, materials for novel electron emission components are continuously being discovered, and this has become a significant topic in related research. The carbon nanotube field emission display devices are utilized mainly based on the principles of tip discharge of carbon nanotubes to replace prior art metal tip-emission components that are short-lived and difficult to manufacture.

The working principle of a field emission display device is similar to that of a conventional Cathode Ray Tube display device. Electrons are drawn out from the tip of the cathode in a vacuum environment by applying an electric field, accelerated by positive voltage at the anode, and impact phosphor powder on the anode plate such that luminescence is generated. Thus, distributive homogeneity of electrons is critical to uniform illumination and light.

Each pixel in the field emission display device has a corresponding field emission array, so in case that electron emitters are distributed unevenly, or areas of emission are different, non-homogenous electron emission could be resulted. Consequently, that phenomenon could cause uneven screen brightness, low contrast, and low yield rate. The image qualities are thereby affected.

In conventional low-cost screen-printing, the material must be shaped through a high-temperature sintering process, but sintered materials cannot form smooth-surface layers and collapse and deform very easily. Furthermore, sizes of the display manufactured by screen-printing are limited, so the precision is difficult to be improved.

Though photolithography is also used to precisely control the arrangement and areas of the electron emitters on the substrate, the process consumes more electron emission materials and thereby incurs higher manufacture costs. Etching and shaping the components could even cause damage to electron emitters. Ink-jet printing is also employed to manufacture electron emitters. Though the procedures are simple, ink-jet printing suffers from the problem that uniformity of thickness is not easily achieved, leading to uneven electron emission.

Therefore, there is a need to develop a method for manufacturing a field emission substrate, which allows accurate controlling distribution of electron emitters on the substrate.

The process is simple and causes no harm to electron emission components, and it is possible to prepare electron emitters having uniform areas and thickness to provide homogenous electron emission, so that image qualities and yield rates are improved.

SUMMARY OF THE INVENTION

The method of the present invention is performed based on the difference of the physical propertied between patterned hydrophobic layer and hydrophilic solution of the electron emitting material, so that the hydrophilic solution adheres to the surface of the patterned hydrophobic layer. Upon evaporation of the hydrophilic solution, a patterned emission layer is formed on the surface of the patterned hydrophobic layer, which is responsible for electron emission. Therefore, the pattern of the emission layer of the present invention is preferably identical to that of the hydrophobic layer, and the pattern of the emission layer is formed by arraying plural electron emitters.

Thus, the method of the present invention can precisely control distribution of emitters on the substrate by patterned hydrophobic layer. In addition, the method of the present invention is simple in its process, causes no harm to electron emission components, and forms uniformly distributed electron emitters on the surface of the substrate, which is helpful to improvement of image qualities and yield rate.

The present invention provides a method for manufacturing a field emission substrate, the steps comprising: (a) providing a substrate having a conductive layer; (b) forming a hydrophobic layer on the conduction layer; (c) patterning the hydrophobic layer; (d) providing a hydrophilic solution having an electron emission material on the surface of the hydrophobic layer so as to form an emission layer on the surface of the hydrophobic layer; and (e) removing the hydrophobic layer from the surface of the conductive layer so that the formed layer of electron-emitting materials can contact the surface of the conductive layer.

The patterned hydrophobic layer comprises a plurality of bumps, and there is no particular limitation to the pitches between neighboring bumps, but they are preferably 1~500 μm, more preferably 10~100 μm. In addition, the pitches between the edges of neighboring bumps can be equal or unequal. In a preferred embodiment, the pitches between the edges of neighboring bumps are equal.

In the patterned hydrophobic layer, there is no particular limitation to the aspect ratio of the bumps, but it is preferably 0.1~3.0, more preferably 0.3~1.2. Moreover, there is no particular limitation to the arrangement of the bumps, but they are preferably arranged in an M×N matrix, wherein each of M and N is an integer greater than zero.

The emission layer is formed on the surface of the hydrophobic layer, so the arranging pattern of the bumps will influence the pattern of the emission layer. Thus, the emission layer can comprise plural electron emitters, wherein each electron emitter can be formed one-on-one on the surface of each bump. By this, it is possible to prepare on the surface of the substrate an emission layer having plural electron emitters that are regularly arranged.

In a preferred embodiment of the present invention, when the bumps of the patterned hydrophobic layer are arranged in an M×N matrix, the electron emitters of the emission layer are also arranged in an M×N matrix, wherein each of M and N is an integer greater than zero. Using the method of the present invention, it is possible to effectively control arraying of electron emitters with patterned hydrophobic layer. The method is simple in its process and reduces manufacture costs significantly.

Further, in step (c) of the method, there is no particular limitation to the ways to pattern the hydrophobic layer. To increase resolution of the field emission display and obtain homogenous field emission, it is preferable to use photolithography to pattern the hydrophobic layer, so as to form a hydrophobic layer having a plurality of bumps.

Besides, the shape and cross-section area of the bumps, and pitches between neighboring bumps will affect the shape, area of the electron emitters prepared by the following procedures, and pitches between neighboring electron emitters. Therefore, the method of the present invention for manufacturing a substrate of a field emission display device can effectively increase precision of electron emission components and resolution of the device.

In the hydrophobic layer, each bump can be of any shape, but they are preferably cubes, columns, polyhedrons, ellipsoids, triangular columns, or irregular shapes. Thus, in the emission layer prepared by the present invention, it is preferable that each electron emitter corresponds to each single bump, and the shape of the cross-section of the electron emitters is preferably identical to that of the bumps.

In step (d), there is no particular limitation to the approaches to provide hydrophilic solutions to the surface of the hydrophobic layer, but they are preferably dropping, spin coating, or soaking, which adheres the hydrophilic solution to the surface of the hydrophobic layer.

See FIG. 1(*a*), at a macro scale, because the physical properties of hydrophobic layer (a) are different to those of hydrophilic solution 13, the hydrophilic solution does not adhere to the surface of the hydrophobic layer. However, as shown in FIG. 1(*b*), at a micro scale, the hydrophilic solution 13 will leave a thin liquid layer 14 on the surface of the hydrophobic layer. The method of the present invention is based on the above-mentioned principle, allowing the hydrophilic solution having the electron emission materials to leave a thin liquid layer on the surface of the hydrophobic layer. After evaporation and drying of the solvent, a patterned emission layer is formed on the patterned hydrophobic layer.

In step (e), there is no particular limitation to removal of the hydrophobic layer, but it is preferable to be removed by heating. Further, there is no particular limitation to heating temperatures of heating in the process mentioned herein, so it is possible to adjust temperature depending on the material of the hydrophobic layer. Preferably, the temperature for removing the hydrophobic layer by heating is 60° C.~550° C.

Besides, the material of the hydrophobic layer can be any conventional one that is hydrophobic, preferably a photoresist, more preferably a dry film photoresist.

In a preferred embodiment, a dry film photoresist is used, and the hydrophobic layer is patterned by photolithography. Then an emission layer is formed on the surface of the hydrophobic layer. Finally, the hydrophobic layer is baked and removed at a high temperature, allowing the emission layer to contact the cathode on the surface of the substrate, which serves as a field emission electric component.

To prepare the hydrophilic solution having electron emission materials, the hydrophilic solution can further comprise any hydrophilic solvent, and the hydrophilic solvent is preferably water, alcohol, or the combination thereof. Moreover, the hydrophilic solution can selectively comprise a dispersant, enabling the electron materials to disperse homogenously in the hydrophilic solution, which is helpful to form a electron emitter having even thickness. There is no particular limitation to the dispersant, but it is preferably a dispersant suitable to hydrophilic solutions.

During preparation of the hydrophilic solution having electron emission materials, there is no particular limitation to the ratio of the contents in the solution, and the ratio and concentration of each content can be adjusted according to the needs of the process.

Besides, there is no particular limitation to the shape of the conductive layer, and the material of the conductive layer can be any one that is conductive. The method of the present invention applies to process of electron emitters of any field emission display, preferably it can be applied to manufacture of substrates of diode or triode field emission displays.

The electron emission materials used in the present invention can be any conventional one that is able to emit electrons, but they preferably comprise a carbon-based material, and the carbon-based material can be selected from a group consisting of graphite, diamond, diamond-like carbon, carbon nanotubes, fullrene, and the combination thereof. In a preferred embodiment, carbon nanotubes are used as the electron emission material, so the present invention relates to a method to manufacture a substrate for a carbon-nanotube-based field emission display device.

The present invention takes advantages of the difference in hydrophobicity between materials so as to manufacture electron emitters that are arranged regularly, while electron emitters are kept intact, and the emission components are not easily damaged. Thus, the method of the present invention can not only simplify the process and lower the manufacture costs, but also arrange the electron emitters in a regular and ordered pattern, so as to provide a substrate for homogenous electron emission.

Other objects, advantages, and novel features of the invention will become more apparent from the following detailed description when taken in conjunction with the accompanying drawings.

BRIEF DESCRIPTION OF THE DRAWINGS

FIG. 1(*b*) is a microcosmic illustration of providing a hydrophilic solution to the surface of a hydrophobic layer in a preferred embodiment of the present invention;

FIG. 2(*b*) is a photo taken by optical microscope after singeing of the hydrophobic layer 12, which shows the lateral side of the substrate;

FIG. 2(*c*) is a photo taken by optical microscope after singeing of the hydrophobic layer 12, which shows the top view of the substrate;

FIG. 4(*b*) is a top view photo of the substrate taken by optic microscope after formation of an emission layer on the surface of patterned hydrophobic layer in a preferred embodiment of the present invention.

DETAILED DESCRIPTION OF THE PREFERRED EMBODIMENT

Example of Preparation

Preparation of a Hydrophilic Solution Containing Electron Emission Materials

The following examples of preparation used CNT powder, water, and dispersant to prepare the hydrophilic solutions containing electron emission materials for the examples described hereafter. There are two kinds of dispersants used, one is produced by Tego Chemie Service, the serial number of which is LA-D 868; the other is a product of Noveon, the serial number of which is solsperse 27000.

Carbon nanotube powder, water, and dispersant are mixed and rolled to form a hydrophilic solution containing electron emission materials, which serve as a slurry containing electron emission materials. Table 1 illustrates weight percentages of contents of the hydrophilic solutions prepared in Preparation Example 1, Preparation Example 2, and Preparation Example 3.

TABLE 1

| | Carbon Nanotube Powder | Water | Dispersant |
|---|---|---|---|
| Preparation Example 1 | 4% | 92% | 4% s-27000 |
| Preparation Example 2 | 2% | 89% | 10% LA-D 868 |
| Preparation Example 3 | 1% | 74% | 25% LA-D 868 |

Example 1

Figure 1:
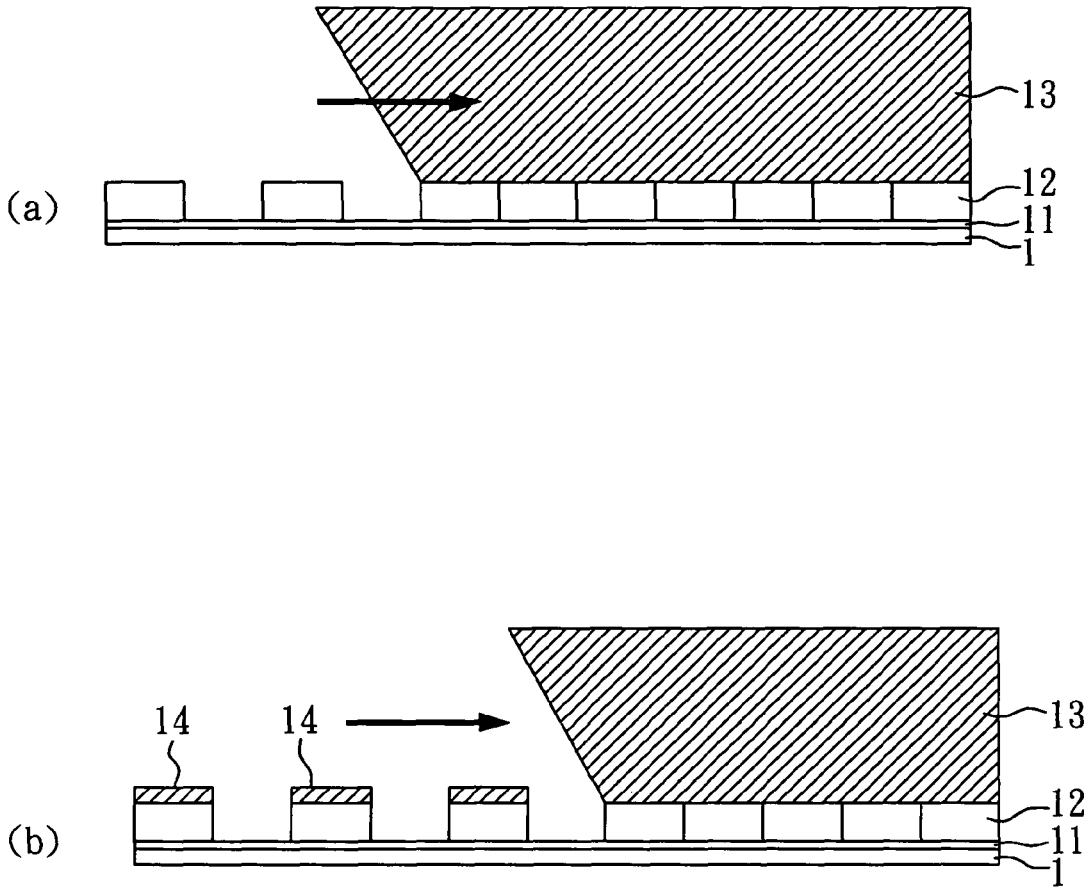
FIG. 1(*a*) is a macrocosmic illustration of providing a hydrophilic solution to the surface of a hydrophobic layer in a preferred embodiment of the present invention.

Described herein is a method for manufacturing a substrate for a field emission display device in a preferred embodiment in the present invention, see FIG. 1(*b*).

First, a substrate 1 having an ITO conductive layer 11 on its surface is provided. Then a hydrophobic layer 12 is deposited on the conductive layer 11, and the hydrophobic layer 12 is patterned by photolithography. In this example, hydrophobic layer 12 is a dry-film photoresist.

The patterned hydrophobic layer 12 comprises plural bumps. The bumps are arranged in an M×N matrix on the surface of the substrate, wherein each of M and N is an integer greater than zero. The pitches between edges of neighboring bumps are equal, around 50 μm. The height of each bump is about 25 μm, and width of the cross-section area is about 50 μm, so the aspect ratio of the bumps in this example is about 0.5.

Of course, the height, width, and shape of the bumps, the pitches between neighboring bumps, and the patterns arranged via the bumps are not restricted to the conditions set forth by this example; instead, they are adjustable depending on needs.

Subsequently, a hydrophilic solution 13 is treated by spin-coating such that a thin liquid film 14 is left on the hydrophobic layer 12. After evaporation of liquid layer 14, an emission layer is formed on the patterned hydrophobic layer.

Figure 2A:
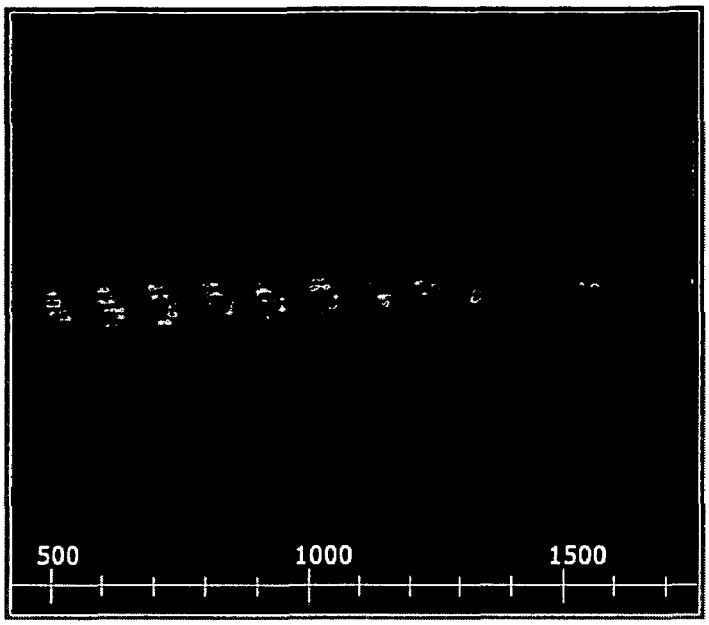
FIG. 2(*a*) is a photo taken after formation of an emission layer on the patterned hydrophobic layer by optical microscope showing the lateral side of the substrate.
Figure 2B:
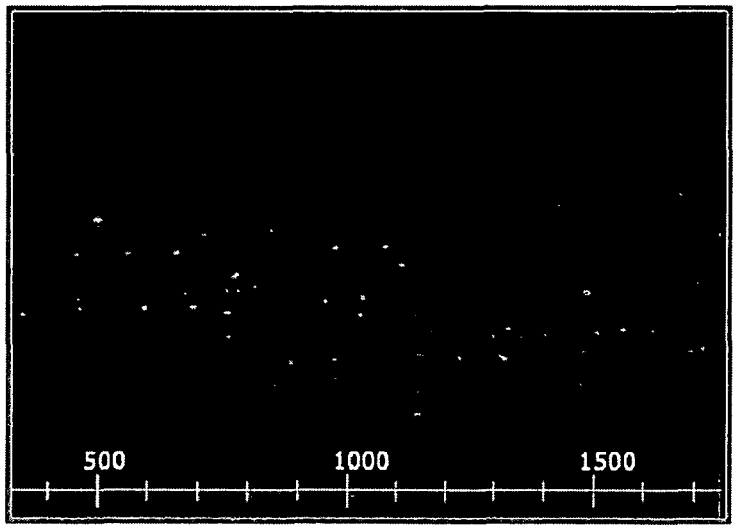
Figure 2C:
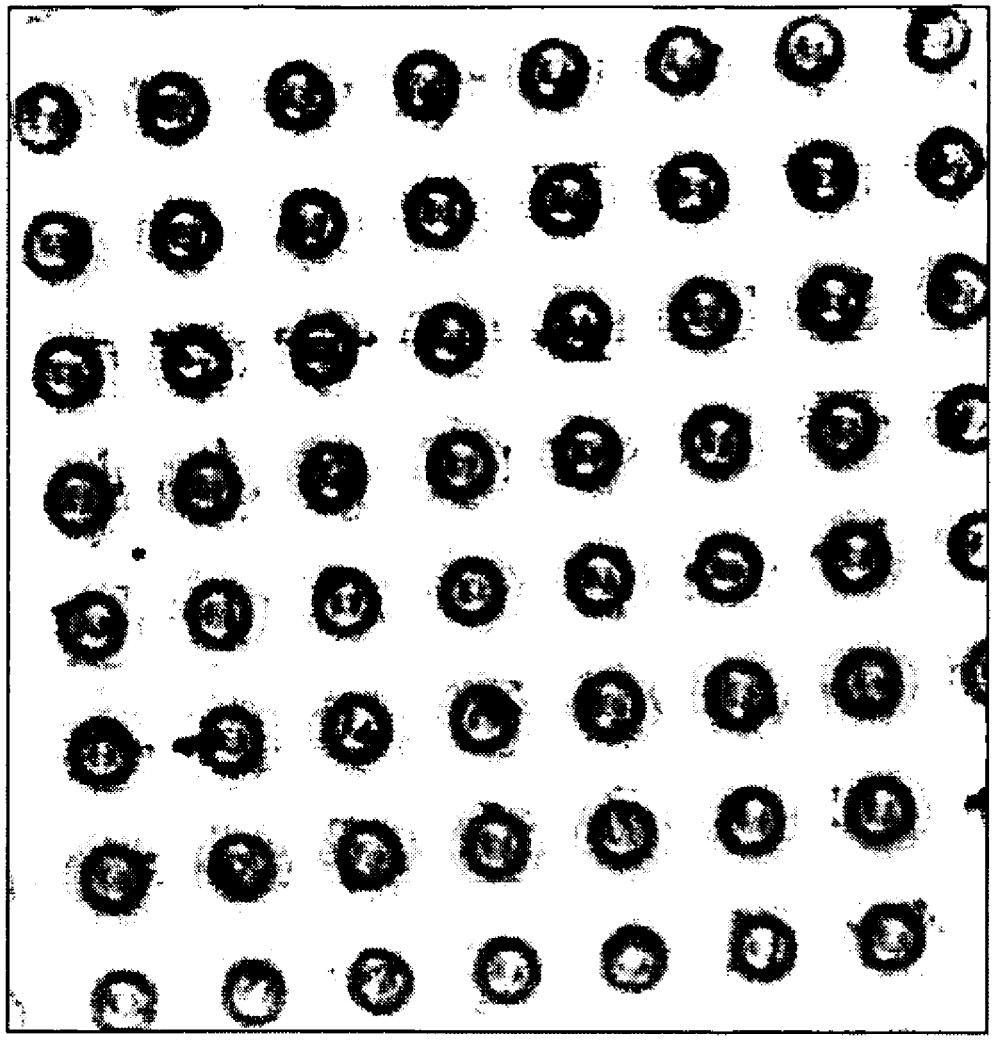

See FIG. 2(*a*), which is a photo taken after formation of an emission layer on the patterned hydrophobic layer by optical microscope showing the lateral side of the substrate. As shown in FIG. 2(*a*), the hydrophobic layer comprises plural bumps and each bump is covered by a thin black drop. Therefore, the thin black drops are the electron emitters prepared by the present invention. The thin black drops each consist an emission layer.

Finally, the obtained substrate is heated at 450° C., so that the hydrophobic layer 12 on the conductive layer 11 is burned and removed, making the electron emitters on the surface of the bumps directly contact the conductive layer 11, and the substrate for field emission display in this example is obtained.

FIG. 2(*b*) is a photo taken by optical microscope after burning and removing the hydrophobic layer 12, which shows the lateral side of the substrate. It is known from the photo that the sizes and shapes of electron emitters formed on the substrate and the pattern formed thereof are influenced by the size of the bumps of the hydrophobic layer 12 and the patterns arranged with the bumps.

FIG. 2(*c*) is a photo taken by optical microscope after burning and removing the hydrophobic layer 12, which shows the top view of the substrate. Because the bumps of the patterned hydrophobic layer in this example are identical in shapes and sizes, and the pitches between the edges of neighboring bumps are equal, it is proved by FIG. 2(*c*) that the electron emitters arrayed on the surface of the conductive layer are identical in sizes and shapes, and the pitches between the edges of the neighboring electron emitters are equal.

From FIG. 2(*c*), the electron emitters of the present invention are round-shaped with a diameter about 50 μm, roughly equal to the width of the cross-section of the bumps.

Test Results of Field Emission

Figure 3:
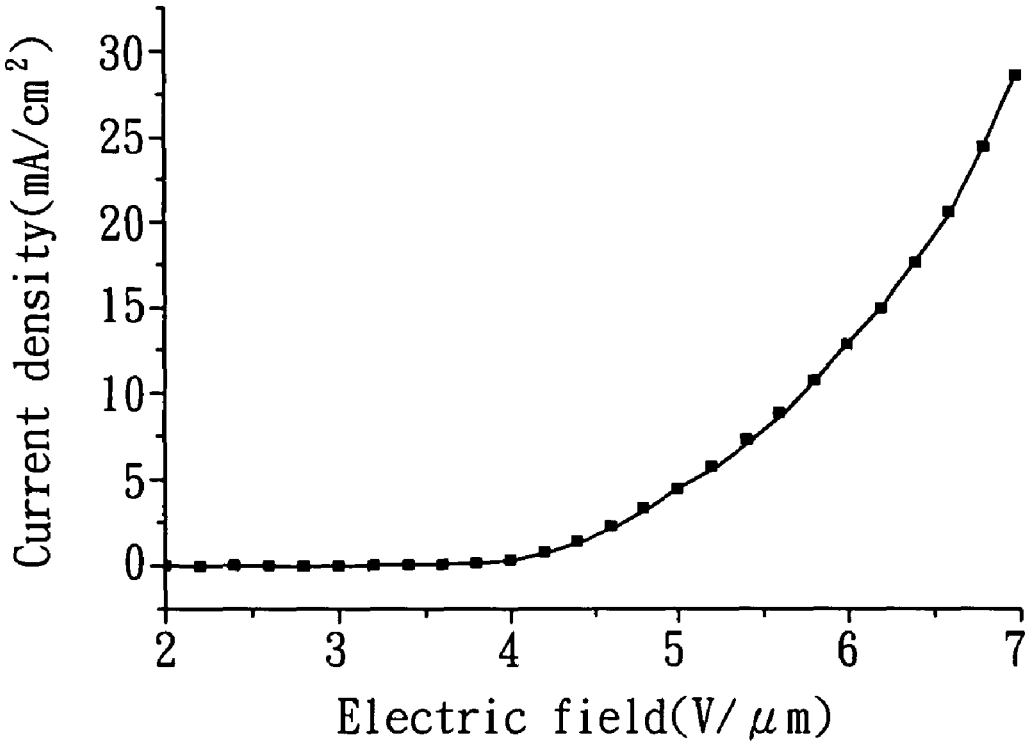
FIG. 3 is the schematic illustration of the test results of field emission by the FED substrate prepared in this example.

The substrate 1 manufactured in this example is cut in test strips that are 1 cm long and 0.5 cm wide and used for tests of diode field emission. FIG. 3 is the schematic illustration of the test results of field emission by the FED substrate prepared in this example. According to the figure, the electron emission source of the substrate prepared in this example is able to emit electrons stably, and the current increases when higher electric field is applied.

Example 2 and Example 3

The procedures and process conditions are the same as set forth in Example 1 except the hydrophilic solutions. Refer to Example 1 for the conditions and procedures.

Figure 4A:
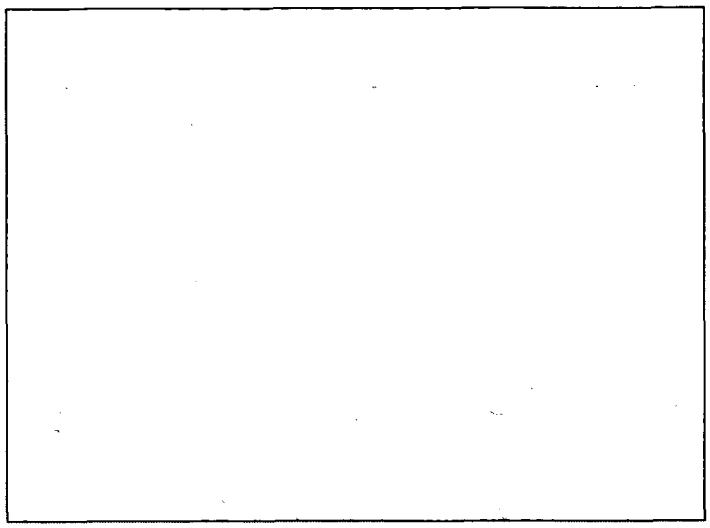
FIG. 4(*a*) is a top view photo of the substrate taken by optic microscope after formation of an emission layer on the surface of patterned hydrophobic layer in a preferred embodiment of the present invention.
Figure 4B:
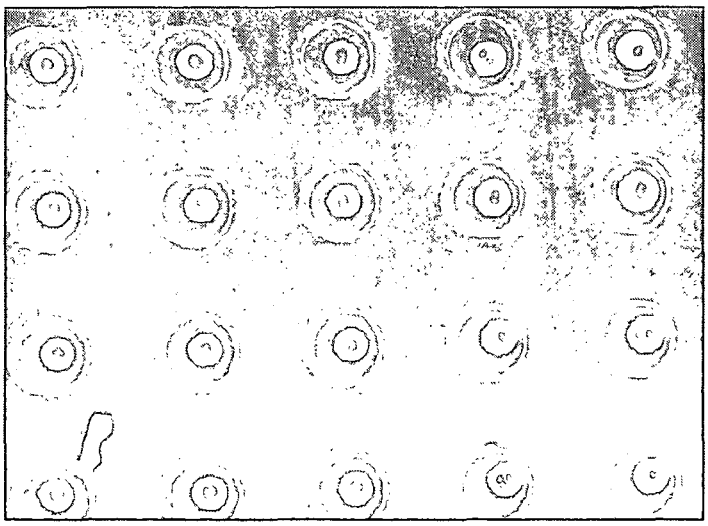

See FIGS. 4(*a*) and 4(*b*). FIG. 4(*a*) is a top view photo of the substrate taken by optic microscope after formation of an emission layer on the surface of patterned hydrophobic layer in Example 2. In FIG. 4(*a*), the results show that the diameters of the round electron emitters formed on the surfaces of the bumps are about 21 μm, while in FIG. 4(*b*), the diameter of the round electron emitters formed on the surfaces of the bumps are about 15 μm. Thus, the sizes of the electron emitters are affected by concentrations of carbon nanotube in the hydrophilic solution.

Example 4

The procedures and process conditions of Example 4 are the same as set forth in Example 1 except for the hydrophilic solutions. Refer to Example 1 for the conditions and procedures.

In the patterned hydrophobic layer, the pitches between edges of neighboring bumps are equal, wherein the pitches are about 25 μm. Besides, the height of the bumps is about 40 cm, and the width of the cross-section is about 20 μm.

Wherein the hydrophilic solution containing electron emission materials is the one prepared in the Preparation Example 1, and an electron emitter having a width of 20 μm is formed on the surface of each bump. Therefore, a substrate having a plurality of electron emitters arranged in a regular and ordered manner is eventually obtained.

Example 5

Figure 5:
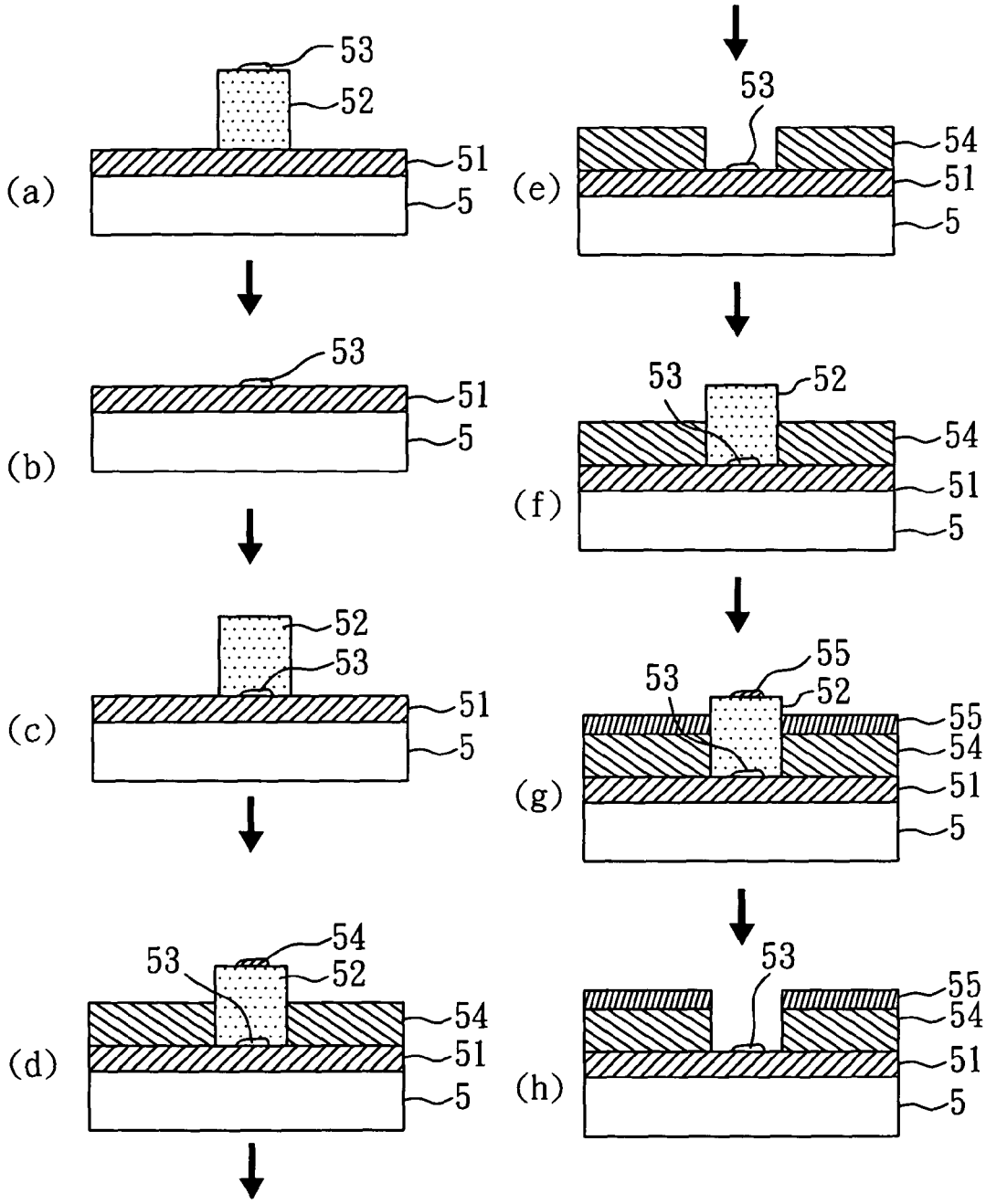
FIGS. 5(*a*)~5(*h*) are schematic illustrations of the flow charts of the method to manufacture the substrate for a triode FED.

FIG. 5 is a schematic illustration of the flow chart of the method to manufacture the substrate for a triode FED.

First, as shown in FIG. 5(*a*), with the same conditions as set forth in Example 1, an emission layer is formed on the surface of the patterned hydrophobic layer 52. For the patterned hydrophobic layer 52, the method to form thereof, the sizes of the plural bumps comprised by the hydrophobic layer, the pitches between bumps, and the pattern arranged within the bumps are identical to those disclosed in Example 1.

The conductive layer of the example is Mo meta, while substrate 5, hydrophobic layer 52, and the materials of each electron emitter 53 formed on the surface of each bump are the same as the process conditions in Example 1. As shown in FIG. 5(*b*), the hydrophobic layer is heated and removed by heating at 450° C., so that each electron emitter 53 contacts directly the surface of the conductive layer 51 and functions to emit electrons.

The lower substrate of a conventional field emission display comprises the components of: cathode, gate electrode, an insulation layer interposed between the cathode and the gate electrode, and electron emitters.

Thus, as shown in FIG. 5(*c*), when proceeding with the subsequent processes such as manufacture insulating layer 54 and gate electrode layer 55, a patterned hydrophobic layer 52 is coated on electron emitters 53 to protect electron emitters 53.

Then, as shown in FIGS. 5(*d*) and 5(*e*), an insulating layer is deposited by screen-printing on the surface of the conductive layer 51, and the hydrophobic layer is singed by heating, such that a substrate structure as FIG. 5(*e*) is obtained. Subsequently, as shown in FIG. 5(*f*), the procedures the same as those in FIG. 5(*c*) are performed to protect the electron emitters 53.

Finally, as shown in FIGS. 5(*g*) and 5(*f*), a gate electrode layer 55 is deposited on the surface of the insulating layer 54, and the hydrophobic layer 52 is singed by heating, such that manufacture of substrate 5 for a triode FED in this example is completed.

Although the present invention has been explained in relation to its preferred embodiment, it is to be understood that many other possible modifications and variations can be made without departing from the scope of the invention as hereinafter claimed.

What is claimed is:

1. A method for manufacturing a field emission substrate, the steps comprising:

(a) providing a substrate having a conductive layer;

(b) forming a hydrophobic layer on the conductive layer;

(c) patterning the hydrophobic layer;

(d) providing a hydrophilic solution having an electron emission material as a thin liquid layer on the surface of the hydrophobic layer so as to form an emission layer on the surface of the hydrophobic layer; and (e) removing the hydrophobic layer from the surface of the conductive layer so that the formed layer of electron-emitting materials can contact the surface of the conductive layer.

2. The method of claim 1, wherein the patterning of the hydrophobic layer forms bumps which are arranged in an M N matrix, and each of M and N is an integer greater than zero.

3. The method of claim 2, wherein the pattern of the emission layer is identical to that of hydrophobic layer and the emission layer comprises plural electron emitters, the electron emitters of the emission layer are arranged in an M N matrix, and each of M and N is an integer greater than zero and each electron emitter is formed one-to-one on the surface of each bump.

4. The method of claim 2, wherein the pitches between neighboring bumps are 1~500 μm.

5. The method of claim 4, wherein the pitches between neighboring bumps are 10~100 μm.

6. The method of claim 2, wherein the aspect ratio of the bumps is 0.1~3.0.

7. The method of claim 6, wherein the aspect ratio of the bumps is 0.3~1.2.

8. The method of claim 2, wherein the pitches between the edges of neighboring bumps are equal.

9. The method of claim 1, wherein the patterning of hydrophobic layer in step (c) is performed by photolithography.

10. The method of claim 1, wherein the hydrophilic solutions in step (d) are provided to the surface of the hydrophobic layer by dropping, spin coating, or soaking.

11. The method of claim 1, wherein the hydrophobic layer in step (e) is removed from the conductive layer by heating.

12. The method of claim 11, wherein the temperature of heating is 60° C.~550° C.

13. The method of claim 1, wherein the hydrophobic layer is a photoresist.

14. The method of claim 13, wherein the photoresist is a dry-film photoresist.

15. The method of claim 1, wherein the hydrophilic solution comprise water or alcohol.

16. The method of claim 15, wherein the hydrophilic solution comprises a dispersant, enabling the electron-emitting materials to disperse homogenously in the hydrophilic solution.

17. The method of claim 1, wherein the bumps are of the shapes of cubes, columns, polyhedrons, ellipsoids, triangular columns, irregular shapes, or the combination thereof.

18. The method of claim 1, wherein the electron emission material comprises a carbon-based material, and the carbon-based material is selected from a group consisting of graphite, diamond, diamond-like carbon, carbon nanotubes, carbon 60, and the combination thereof.

19. The method of claim 1, wherein the patterning of the hydrophobic layer forms bumps which are arranged in an M N matrix, and each of M and N is an integer greater than zero, wherein the emission layer comprises plural electron emitters, the electron emitters of the emission layer are arranged in an M N matrix corresponding to said bumps, and each of M and N is an integer greater than zero; wherein the pitches between neighboring bumps are 1~500 μm and the pitches between the edges of neighboring bumps are unequal, and the aspect ratio of the bumps is 0.1~3.0 and wherein the hydrophilic solution in step (d) is provided to the surface of the hydrophobic layer by dropping, spin coating, or soaking.

20. The method of claim 19, wherein the pitches between neighboring bumps are 10~100 μm and the aspect ratio of the bumps is 0.3~4.2.

21. The method of claim 1, wherein the hydrophilic solution comprises water or alcohol, the hydrophobic layer is a dry-film photoresist, and the hydrophilic solution comprises a dispersant enabling the electron-emitting materials to disperse homogeneously in the hydrophilic solution.

* * * * *